US006932081B2

(12) United States Patent
Stonier

(10) Patent No.: US 6,932,081 B2
(45) Date of Patent: Aug. 23, 2005

(54) FIRE SURROUND

(75) Inventor: Christopher Simon Stonier, Newcastle-under-Lyme (GB)

(73) Assignee: Paul Agnew, Camberwell (AU)

( * ) Notice: Subject to any disclaimer, the term of this patent is extended or adjusted under 35 U.S.C. 154(b) by 18 days.

(21) Appl. No.: 10/276,102

(22) PCT Filed: May 30, 2001

(86) PCT No.: PCT/GB01/02373

§ 371 (c)(1),
(2), (4) Date: Aug. 8, 2003

(87) PCT Pub. No.: WO01/94851

PCT Pub. Date: Dec. 13, 2001

(65) Prior Publication Data

US 2004/0045545 A1 Mar. 11, 2004

(30) Foreign Application Priority Data

Jun. 2, 2000 (GB) ..... 0013307

(51) Int. Cl.[7] ..... F24C 3/00
(52) U.S. Cl. ..... 126/512; 126/544
(58) Field of Search ..... 126/512, 544, 126/545, 298; 52/36.3

(56) References Cited

U.S. PATENT DOCUMENTS 4,773,589 A * 9/1988 Boyd ..... 126/504
5,772,423 A * 6/1998 Mandir ..... 431/254
6,463,926 B1 * 10/2002 Flick et al. ..... 126/512
6,640,802 B2 * 11/2003 Grando et al. ..... 126/503

FOREIGN PATENT DOCUMENTS

GB 2 258 914 A 2/1993
GB 2 337 580 A 11/1999

* cited by examiner

*Primary Examiner*—Alfred Basichas
(74) *Attorney, Agent, or Firm*—Peter S. Gilster; Greensfelder, Hemker & Gale, P.C.

(57) ABSTRACT

A fire surround for use with a substantially enclosed gas fire unit (34) comprises an outer fascia (12) securable, in use, to a chimney breast around a flue opening in the chimney breast, the outer fascia having an opening therein for receiving the gas fire unit (34), and an inner fascia (22) securable, in use, to the outer fascia (12) so as to entrap an out-turned flange (40) of the gas fire unit (34) between the inner and outer fascias. The inner fascia (22) comprises a pair of side columns (26) bridged by a top portion (28), and at least one of the side columns (26) is formed as a channel member for receiving a slide control for operating the gas fire unit (34). The invention also provides a method for the securing such a fire surround to a chimney breast so as to secure in place the gas fire unit (34).

16 Claims, 7 Drawing Sheets

FIRE SURROUND

CROSS REFERENCE TO RELATED APPLICATION AND CLAIM FOR PRIORITY

This application is based upon International Application Number PCT/GB01/02373, having an international filing date of 29 May 2001 which claims priority to GB 0013307.4, filed 2 Jun. 2000 entitled "Fire Surround", the contents of which are incorporated herein by reference in their entirety. Priority is claimed accordingly from the foregoing patent applications.

1. TECHNICAL FIELD

The invention relates to a surround for a fire and particularly to a surround for containing an enclosed gas fire unit.

2. BACKGROUND ART

Traditional Victorian fire surrounds include an opening which communicates with the chimney and in which is provided a grate for the fire, the opening being surrounded by a decorative fascia. The fascia is conventionally made in one piece from cast iron and may include an inner trim and hood framing the opening and an integral outer decorative border defining an outer edge of the fire surround. The fascia may include decorative tiles located between the border and the trim.

Victorian style fireplaces continue to be popular and may be adapted for use with gas fires. Conventionally, the grate is removed and a gas inset tray inserted in its place through the opening in the inner trim. The gas fire thereby simply takes the place of an open fire. The gas fire may be coal or log effect, etc., and is conventionally open to and vented by the chimney.

Such gas fires generally have a rated output of about 2 kW but the effective output may be significantly lower. It has been appreciated by the applicant that much of the heat provided by such fires is lost via the chimney, particularly if the ambient temperature of the room is relatively high. Thus although such fires have an attractive appearance, they may not significantly heat the room. Certainly their useful heat output into the room is considerably less than that of gas fires incorporating substantially enclosed gas fire units, which incorporate radiant or convector box housings. Such substantially enclosed gas fire units, however, cannot be used without modification to enable them to be inserted through the opening in the inner trim of a Victorian style fire surround.

SUMMARY OF THE INVENTION

According to the invention there is provided a fire surround for use with a substantially enclosed gas fire unit, the fire surround including an outer fascia securable, in use, to a wall around a flue opening in the wall, the outer fascia having an opening therein for receiving the gas fire unit, and an inner fascia securable, in use, to the outer fascia so as to entrap an out-turned flange of the gas fire unit between the inner and outer fascias; wherein the inner fascia comprises a pair of side columns bridged by a top portion, and at least one of the side columns is formed as a channel member for receiving a slide control for operating the gas fire unit.

Preferably the fire surround is made wholly or substantially wholly of cast iron.

Preferably the outer fascia comprise a decorative outer border member surrounding an inner frame which is substantially the same size as the inner fascia and which defines the opening for receiving the gas fire unit. The inner frame may comprise side elements extending vertically from the bottom of the outer fascia to the top where they are secured to the border member, and a top element which bridges the side elements to define the top of the opening for receiving the gas fire unit. Preferably bridging strap members connect together the outer border member and the inner frame at the bottom of the inner frame side elements.

In use the outer fascia is secured either directly to the wall or indirectly by bolting it to a mounting plate which has been anchored to the wall immediately surrounding the flue opening so as to create an accurate planar surface against which to fit the outer fascia. The use of a mounting plate is preferred in situations in which the wall is damaged or otherwise not flat around the flue opening, as the wall can be resurfaced up to the mounting plate before presenting up the outer fascia.

When the outer fascia has been secured in place, the fire unit can be presented up. The main fire box of the fire unit passes completely (and preferably closely) through the opening defined by the inner frame, although a peripheral out-turned flange around the fire box does not pass through the opening but abuts the front face of the inner frame. Conventional substantially enclosed gas fire units have two mounting holes at a standard position and spacing in the portion of the out-turned flange defining the top front edge of the fire box, and preferably the outer fascia incorporates two screw-threaded projecting studs positioned to pass through those mounting holes as the gas fire unit is presented up to the opening. The screw-threaded projecting studs are used to secure in position the inner fascia.

When the inner fascia is presented up, the out-turned flange around the fire box is entrapped between the inner and outer fascias. The screw-threaded projecting studs of the outer fascia pass into recesses in the inner fascia, and when fastening nuts are threaded onto the studs the inner and outer fascias are held securely together with the gas fire unit firmly held in position.

If a space is provided between the border member of the outer fascia and the inner fascia, then that space can be filled by adding tiling or strips of marble.

Conventional substantially enclosed gas fire units are provided with gas flame controls positioned at the bottom-front, generally hidden behind a front iron of the fire surround, or at the side, generally at a higher level. The front iron, which is the equivalent of an ash-door in the traditional Victorian fireplace, may be detachably securable to the inner fascia to provide access to bottom-front controls. The fire surround of the invention is, however, designed for use with either bottom-front controls or side controls. Whereas the bottom-front controls conventionally comprise a rotary control knob for varying the gas flow, the side controls conventionally use slide controls.

The inner fascia comprises side columns and a top bridging portion. According to the invention one or preferably both of the side columns are formed as channel members defining an opening for receiving the slide controls which transmit movement from a control slide lever accessible to a user down to a gas flow valve at the bottom of the gas fire unit. Preferably a side recess provides access to the control slide lever from a position relatively high up the side columns of the inner fascia. A blanking piece can fill the or each side recess in the event that in any particular installation the channel member forming a side column of the inner fascia is not used to house the slider lever.

The outer fascia may be formed wholly or in part from cast iron. Preferably the decorative border member is made as a single-piece casting. The inner fascia may be formed, also, from cast iron. In that case the formation of the side columns of the inner fascia as channel members has the additional advantage of reducing the weight and cost of the inner fascia by reducing the amount of material used.

The inner fascia may be provided with a hood, which may be releaseably attachable to the side columns or top portion of the inner fascia. Advantageously the screw-threaded projecting studs of the outer fascia are used to secure both the inner fascia and the hood to the outer fascia.

The outer fascia preferably further includes one or more mounting members, to which the inner fascia is detachably securable. Preferably the or each mounting member is located inwardly of the border member.

Preferably the or each mounting member comprises a cross piece which is oriented generally horizontally in use. Preferably the cross piece is spaced from and located generally below the top element of the border member. The cross piece is preferably mounted on two supports which are substantially vertical in use and which are located inwardly of the side elements. Preferably the or each cross piece extends between the two supports.

The mounting member may be provided with one or more projecting studs, for mounting the inner fascia thereon. Preferably the mounting member includes two such studs spaced apart and projecting generally horizontally from the mounting member in use. The studs may be adapted to pass through openings in an upwardly projecting flange of a gas fire unit.

The inner fascia preferably includes a trim arrangement comprising side members which are oriented substantially vertically in use and a top member which bridges the tops of the side members and which is oriented substantially horizontally in use. Preferably the side and top members are elongate and present substantially flat faces to a front of the trim arrangement. Preferably the side and top elements of the trim arrangement lie substantially flush in use with the side and top members of the border member. Preferably in use the side and top elements of the trim arrangement lie inwardly of the side and top members of the border member.

Preferably in use the side and top members of the trim arrangement lie partially in front of the fire unit.

The inner fascia may further include a hood, which may be releasably attachable to the side or top members of the trim arrangement. Preferably in use the hood lies generally above and partially in front of the fire unit.

The inner fascia may further include a front iron, which may be detachably securable to the side members of the inner fascia. Preferably in use the front iron lies partially in front of the fire unit at a lower region thereof.

DRAWINGS

An embodiment of the invention will be described for the purpose of illustration only with reference to the accompanying drawings in which.

Figure 1:
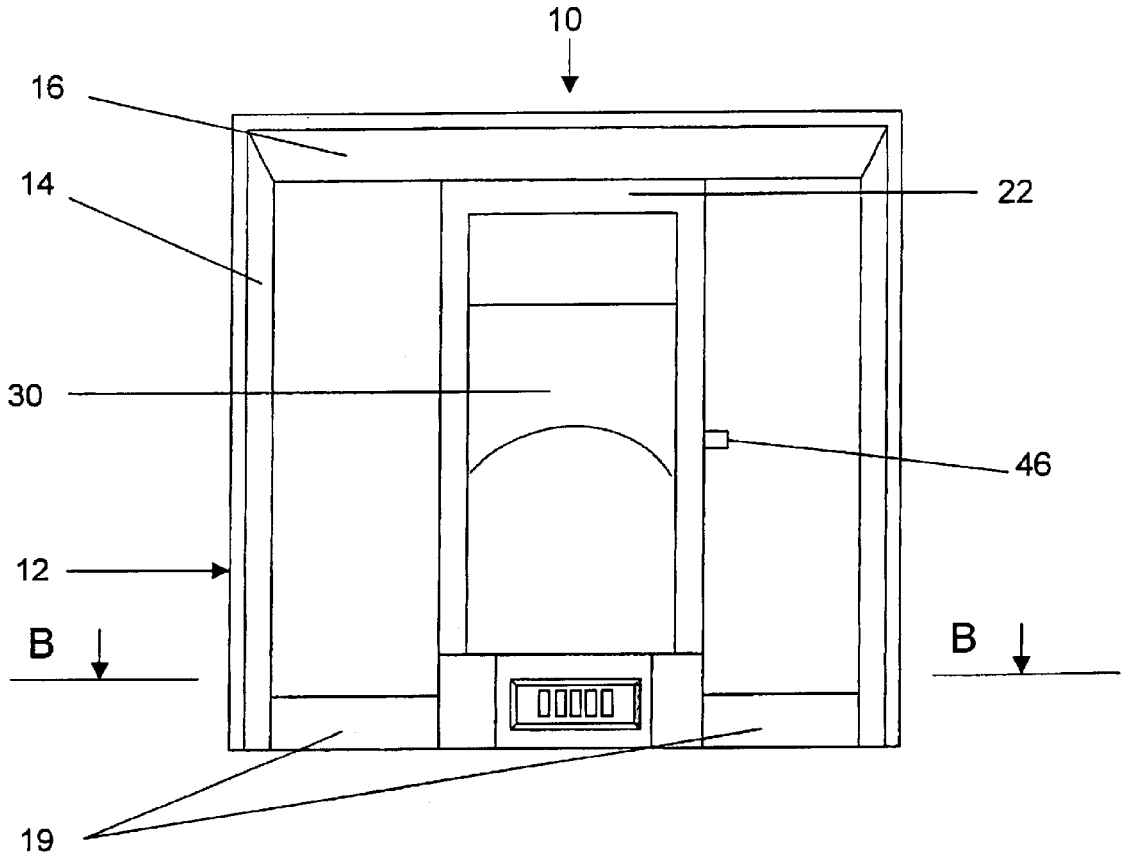
FIG. 1 is a diagrammatic front view of a fire surround according to the invention.

Referring to the drawings, a fire surround 10 includes an outer fascia 12 and an inner fascia 22. The outer fascia 12 includes a border member which defines the outer boundary of the fire surround 10, and a mounting portion which serves to attach the outer fascia 12 to the inner fascia 22 as described below. The border member includes elongate side elements 14 which lie generally vertically in use and an elongate top element 16 which lies generally horizontally in use and which bridges the tops of the side elements 14. The side and top elements 14 and 16 respectively each present generally flat faces towards a rear of the fire surround.

Figure 2:
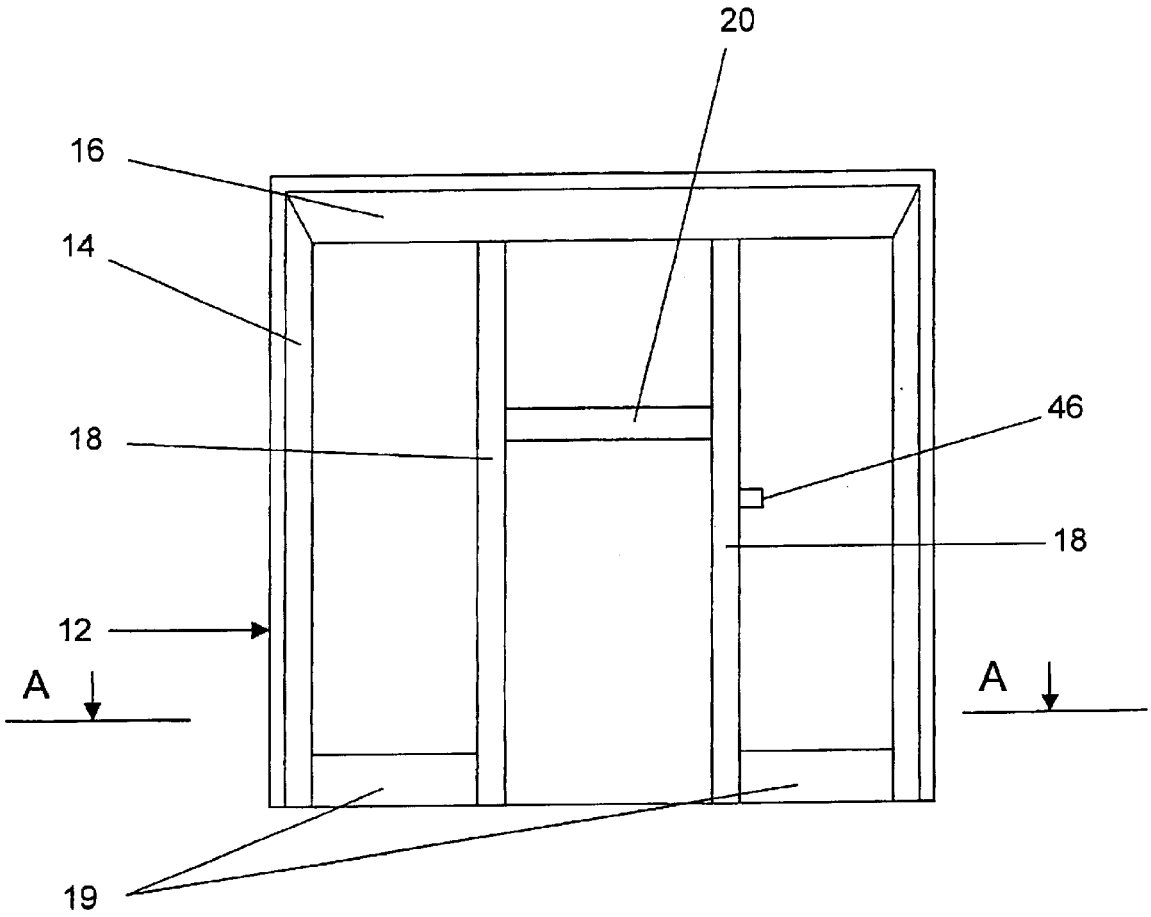
FIG. 2 is a diagrammatic front view of the outer fascia of the fire surround of FIG. 1.
Figure 4:
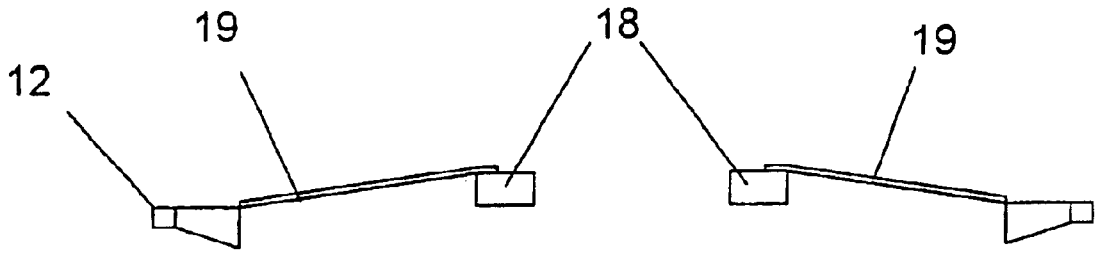
FIG. 4 is a diagrammatic cross section taken along the line A—A of FIG. 2.

Referring to FIG. 2, the mounting portion includes two supports 18 which lie inwardly of and slightly behind (see FIG. 4) the side elements 14, generally parallel thereto.

The supports 18 extend between a base of the fire surround and the top element 16 and are located approximately 10 inches (25 cm) to 20 inches (50 cm) inwardly of the side elements 14. Extending between the supports 18, generally parallel to and spaced from the top element 16 of the border member, is a cross piece 20. The function of the cross piece 20 is described in more detail below. A bridging strut 19 extends between the base of each support 18 and its adjacent side element 14.

Figure 3:
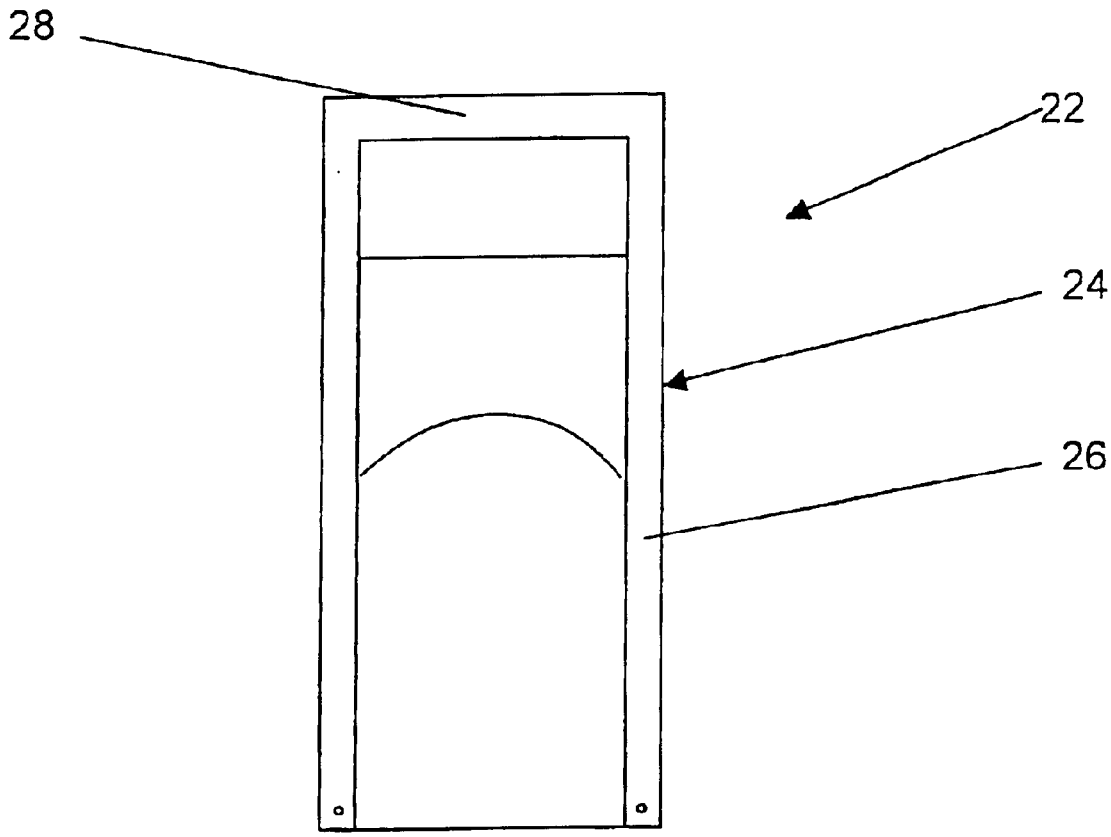
FIG. 3 is a diagrammatic front view of the inner fascia of the fire surround of FIG. 1.

Referring in particular to FIGS. 1 and 3, the inner fascia 22 includes a trim 24 consisting of side columns 26 which are generally vertical in use and a top portion 28 bridging the tops of the side columns 26. The side columns and top portion 26 and 28 of the trim 24 are located marginally inwardly of the side and top elements 14 and 16 of the border member. The side columns and top portion 26 and 28 of the trim 24 each present a generally flat face to the rear of the fire surround 10, these flat faces being approximately flush with the faces of the side and top elements 14 and 16 of the border member when the fire surround 10 is assembled.

Figure 5:
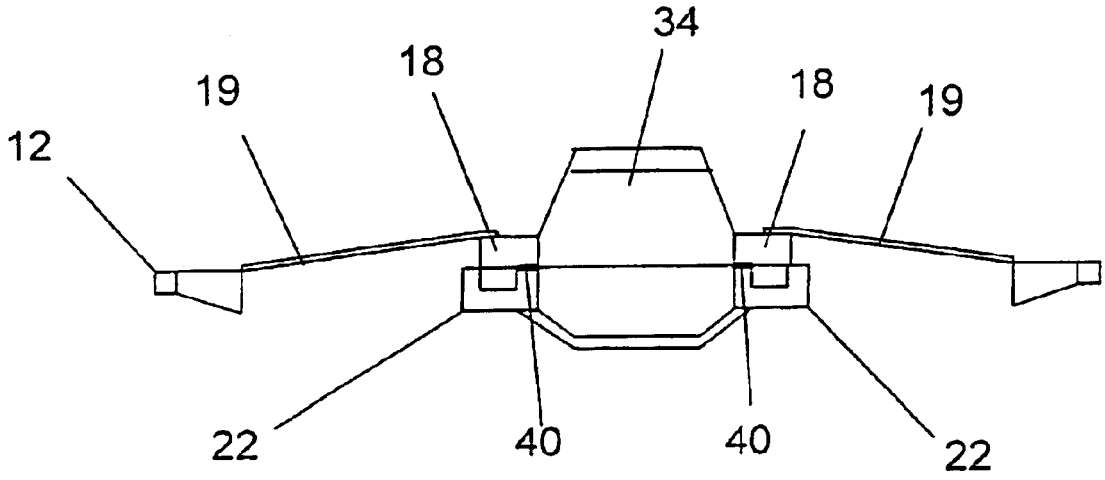
FIG. 5 is a diagrammatic cross section taken along the line B—B of FIG. 1.
Figure 6:
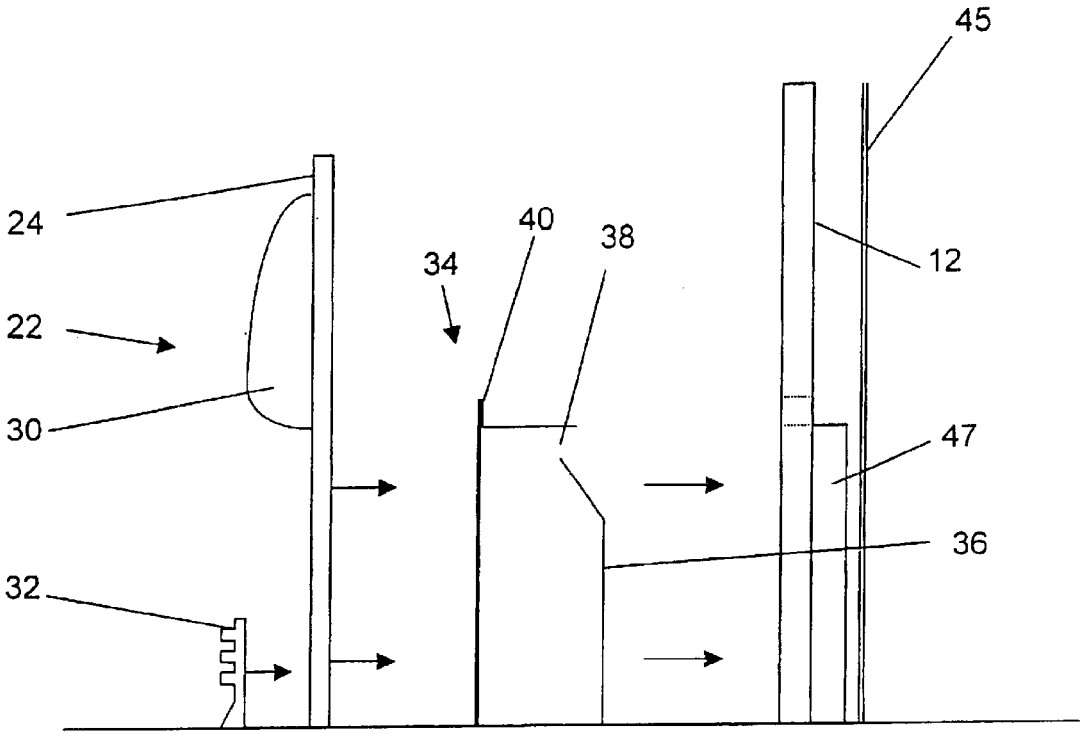
FIG. 6 is an exploded side view illustrating the assembly of the fire surround of FIG. 1.

Referring in particular to FIGS. 5 and 6, a fire unit includes a gas appliance 34 incorporating a radiant or convector box housing 36. The housing 36 includes a rear vent 38 which communicates with a chimney in use. The gas appliance 34 includes a gas burner unit (not shown) located with the housing 36. Because the burner unit is fully contained except for the small vent 38, it is much more efficient than an open gas fire.

Figure 7:
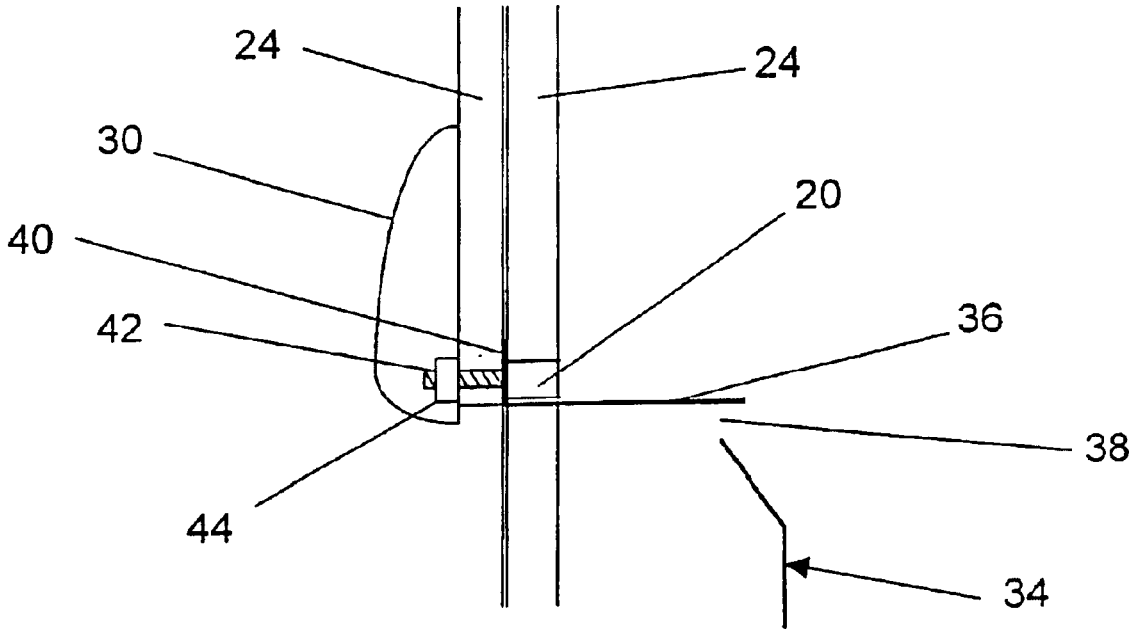
FIG. 7 is a diagrammatic partial cross section through the assembled fire surround of FIG. 6.

Referring to FIGS. 5 to 7, the housing 36 of the gas appliance 34 includes a front flange 40 consisting of a piece of sheet metal extending outwardly around the main body of the housing 36 at a front region thereof. The width of the flange is always the same and is in accordance with the relevant British Standard. Two standard openings are provided in an upper portion of the flange 40 and two corresponding standard openings are provided in an upper portion of the trim 24. Two standard openings (not shown) are provided in a lower portion of the flange 40 and two corresponding threaded openings (unreferenced—FIG. 3) are provided in a lower portion of the side members 26 of the inner fascia 22.

The cross piece 20 of the mounting member is provided with two studs 42 (FIG. 7) which project generally horizontally from the cross piece 20, towards a front of the fire surround 10. The studs 42 are threaded and are sized and positioned to be able to pass through the standard openings in the upper portion of the flange 40 and the standard openings in the trim 24. A nut 44 is threadably engageable with each stud 42.

Referring to FIGS. 6 and 7, the fire surround 10 may be assembled as follows. First of all a closure plate 45 (FIG. 6) is secured to the wall of the chimney breast. The closure plate 45 is a flat plate which surrounds the fireplace opening in the chimney breast. If the wall of the chimney breast is uneven, then the closure plate 46 can be fastened to the wall in the vertical plane and used as a plastering bead to plaster or cement render the wall to build it out to a flat vertical face. The cement render does not cover the closure plate 45 which therefore provides a smooth face against which the outer fascia 12 can seal.

The function of the closure plate 45 is to seal the fire surround 10 to the chimney breast. The housing 36 of the gas appliance is 16 inches (41 cm) wide and 22 inches (56 cm) high. It is also about 5 inches (12 cm) deep although this may vary depending on the type of gas appliance and on the type of flue. The closure plate 45 consists of side uprights which are generally vertical in use and a top portion bridging the tops of the side uprights. The opening between the two side uprights and the top portion is 16 inches (41 cm) wide and 22 inches (56 cm) high and is designed perfectly to accommodate the housing 36. The side uprights and top portion are each 4 inches (10 cm) wide and present generally flat faces towards a front of the closure plate. A number of openings is provided in the closure plate 45 each for receiving a screw.

The two supports 18 and the cross plate 20 of the mounting member include a continuous L-shaped flange 47 (FIG. 6) which extends towards a rear of the fire surround 10. The L-shaped flange 47 is cast as an integral part of the mounting member.

The fire surround 10 may be sealed to the chimney breast as follows. If the hole in the chimney breast is less than 16 inches (41 cm) wide or 22 inches (56 cm) high then it is widened in the usual way. The closure plate is then screwed to the chimney breast and any voids are filled. Then the fire surround is positioned so that the L-shaped flange 47 provided on the mounting portion of the outer fascia abuts the front of the closure plate and the gas appliance is received within the hole in the chimney breast. The L-shaped flange 47 is finally sealed to the closure plate with fire cement.

Because the L-shaped flange 47 is provided on the mounting portion of the outer fascia 12 the hole in the chimney breast does not need to be the full 5 inches (12 cm) deep. Furthermore, because the side members and top member of the closure plate are each 4 inches (10 cm) wide then the hole in the chimney breast does not need to be exactly 16 inches (41 cm) wide or 22 inches (56 cm) high. The only requirement is that there is sufficient chimney breast for the closure plate to be screwed to securely.

Once the closure plate 45 has been secured in position, the outer fascia 12 is presented up to the backing plate 45 and secured in position.

The gas appliance 34 can then be positioned within the supports 18 and the cross piece 20 of the outer fascia 12, as shown in FIG. 6. In this position, the flange 40 of the gas appliance 34 lies in front of and alongside the cross piece 20. The gas appliance 34 is positioned so that the projecting studs 42 pass through the standard openings in the upper portion of the flange 40. The inner fascia 22 is then positioned so that the projecting studs 42 pass through the standard openings in the upper portion of the trim 24, whereupon a nut 44 may be screwed on to each stud 42. This seals the gas appliance 34 between the mounting member of the outer fascia 12 and the inner fascia 22 and no additional sealing with silicone or fire cement is required. To ensure that the gas appliance 34 is properly secured to the fire surround 10 a bolt is passed through each of the standard openings in the lower portion of the flange 40 and into the threaded openings in the lower portion of the mounting member.

The inner fascia 22 further includes a hood 30 that is releasably securable to the trim 24 by means of a screw fixing accessible from the back of the trim 24. The hood 30 is securable to the trim 24 so the nuts 44 are hidden by the hood 30 but can be accessed by reaching up under the hood 30.

The housing 36 of the gas appliance 34 is a uniform size, namely 16 inches (41 cm) wide and 22 inches (56 cm) high, and is open on a front side. To prevent waste gas produced by the gas burner from spilling into the room a canopy is provided at an upper portion of the housing 36. In a convector gas appliance, air is cycled around the back of the housing 36 and above the canopy to give added convention. This requires the canopy to be placed lower down in the housing 36 where it might be seen. The hood 30 is therefore secured to the trim 24 so that it substantially conceals the canopy.

The inner fascia 22 further includes a front iron 32 which is also releasably securable to the side members 26 of the trim 24 by hooks. The front iron 32 is securable to the trim 24 such that it is positioned generally in front of and at a lower region of the trim 24 where it conceals the bolts used to secure the gas appliance 34 to the mounting member and the gas appliance's control mechanisms (not shown).

When the fire surround 10 is assembled as described above, the gas appliance 34 is retained in position by the inner fascia 22, with the mounting flange 40 concealed behind the inner fascia 22. This gives the fire an authentic appearance, whilst still allowing easy access to the gas appliance 34.

Referring to FIGS. 1 and 2, a slide control lever 46 for the gas appliance 34 may project from a side of the trim 24, allowing the gas appliance 34 to be operated easily, but without spoiling the appearance of the fire surround 10. To achieve that the or each side column 26 of the inner fascia 22 is formed as a channel member to receive a control linkage for operating the gas fire unit. By forming both side columns 26 as channel members the user can choose whether to have the slide control lever 46 on the left or the right. The slide control lever 46 passes through a side cutout in the side column 26. If desired blanking pieces can be provided to fill one or both such cut-outs if they are not used.

The formation of the side columns 26 as channel members represents a great improvement in the versatility of the gas fire controls. The controls can be designed to be accessible from the left or right of the fireplace opening or from the traditional position behind the front iron 32.

For side control of the gas fire, the channel formed in the rear of each side column 26 creates a vertical groove which can accommodate a linkage such as a vertical lever or Bowden cable (not shown) extending between the slide control 46 and the control mechanism. The vertical lever may be connected to a bell-crank and then to a piston valve assembly to start the gas appliance 34.

If the gas fire is a powerflue gas fire, which has a fan assisted flue at the rear, then it may be installed in a dwelling in which no conventional flue or chimney exists. For use with such a gas fire, the fire surround may be simply modified to expose switches at the sides of the vertical side columns 26 in place of the slide control 46 of FIGS. 1 and 2. Electrical wiring from those switches can be accommodated in the internal channels formed in the side columns 26.

The versatility of the fire surround of the invention is illustrated by the fact that it can without significant modification receive an electric fire unit in place of the enclosed gas fire unit for which it is primarily designed. Switches for the control of the electric fire unit can be exposed at the sides of the vertical side columns 26 as described above in place of the slide control 46 of FIGS. 1 and 2, and electrical wiring from those switches can be accommodated in the internal channels formed in the side columns 26.

What is claimed is:

1. A fire surround for use with a substantially enclosed gas fire unit, the fire surround comprising:

an outer fascia securable, in use, to a wall around a flue opening in the wall, the outer fascia having an opening therein for receiving the gas fire unit, and an inner fascia securable, in use, to the outer fascia;

wherein an out-turned flange of the gas fire unit is entrapped between the inner and outer fascias and wherein the inner fascia comprises a pair of side columns bridged by a top portion.

2. A fire surround according to claim 1, wherein at least one of the side columns is formed as a channel member for receiving an operating lever for slide control for operating the gas fire unit.

3. A fire surround according to claim 1, wherein the two vertical side columns and the horizontal top portion of the inner fascia are elongate and present substantially flat faces to a rear of the fire surround.

4. A fire surround account to claim 1, wherein the inner fascia further includes a hood being detachably securable to an upper portion of the inner fascia.

5. A fire surround according to claim 4, wherein the gas fire unit includes a canopy and wherein the hood is detachably securable to the inner fascia so as to lie generally above and partially in front of the gas fire unit so that the canopy is substantially concealed.

6. A fire surround according claim 1, wherein the inner fascia further includes a front iron which is detachably securable to a lower portion of the inner fascia so as to lie partially in front of a lower region of the gas fire unit.

7. A fire surround according to claim 1, wherein the outer fascia comprises an outer border member and a central mounting portion, and the border member comprises two vertical side elements and a horizontal lop element which bridges the tops of the two side elements.

8. A fire surround according to claim 7, wherein the two vertical side elements and the horizontal top element of the border member are elongate and present substantially flat faces to a front of the fire surround.

9. A fire surround according to claim 7, wherein the two vertical side columns and the horizontal top portion of the trim lie substantially flush in use with the two vertical side elements and the horizontal top element of the border member.

10. A fire surround according to claim 9, wherein the two vertical side columns and the horizontal top portion of the trim lie inwardly of the two vertical side elements and the horizontal top element of the border member.

11. A fire surround according to claim 10, wherein the central mounting portion of the outer fascia includes two vertical supports located inwardly of the side columns of the border member and a horizontal cross piece extending between the two vertical supports and spaced from and located generally below the top portion of the border member.

12. A fire surround according to claim 10, wherein the horizontal cross piece is provided with two studs spaced apart and projecting generally horizontally from the horizontal cross piece so as to pass through openings in an outwardly projecting flange of the gas fire unit.

13. A fire surround according to claim 12, wherein the two studs also pass through openings in the inner fascia to seal the gas fire unit between the outer fascia and the inner fascia.

14. A fire surround according to claim 13, wherein the central mounting portion further includes an L-shaped flange extending toward the rear of the fire surround.

15. A fire surround according to claim 1, wherein the outer fascia and inner fascia are made of cast iron.

16. A method of securing a fire surround according to claim 1 to a chimney breast having a hole for receiving the gas fire unit, the method including the steps of:

fixing to the chimney breast a closure plate having an opening sized to match the external dimensions of the gas fire unit so that the opening is aligned with the hole in the chimney breast;

optionally making good the chimney breast up to the closure plate;

presenting up the outer fascia to the chimney breast with the opening therein aligned with the opening in the closure plate;

securing the outer fascia to the chimney breast;

presenting up the gas fire unit through the aligned openings in the closure plate and outer fascia with an out-turned flange of the gas fire unit overlapping a front face of the outer fascia; and securing the inner fascia to the outer fascia so as to overlap the out-turned flange of the gas fire unit and entrap that flange between the inner and outer fascias.

* * * * *

UNITED STATES PATENT AND TRADEMARK OFFICE

CERTIFICATE OF CORRECTION

PATENT NO. : 6,932,081 B2
DATED : August 23, 2005
INVENTOR(S) : Christopher Simon Stonier It is certified that error appears in the above-identified patent and that said Letters Patent is hereby corrected as shown below:

Title page,
Item [22], Filing Date, should read -- May 29, 2001 --.

Column 7,
Line 1, replace "account" with -- according --.

Signed and Sealed this

Twenty-fifth Day of October, 2005

JON W. DUDAS
*Director of the United States Patent and Trademark Office*